US010499735B1

(12) United States Patent
Cooper

(10) Patent No.: US 10,499,735 B1
(45) Date of Patent: Dec. 10, 2019

(54) DESK WITH SLIDABLE DRAWER ASSEMBLY

(71) Applicant: Sunjoy Industries Group Ltd., Steubenville, OH (US)

(72) Inventor: John David Cooper, Lawrenceville, GA (US)

(73) Assignee: Sunjoy Industries Group Ltd., Steubenville, OH (US)

( * ) Notice: Subject to any disclaimer, the term of this patent is extended or adjusted under 35 U.S.C. 154(b) by 0 days.

(21) Appl. No.: 15/996,270

(22) Filed: Jun. 1, 2018

(51) Int. Cl.
*A47B 83/00* (2006.01)
*A47B 83/04* (2006.01)
(Continued)

(52) U.S. Cl.
CPC ..... *A47B 83/045* (2013.01); *A47B 13/12* (2013.01); *A47B 88/407* (2017.01);
(Continued)

(58) Field of Classification Search
CPC ..... A47B 88/045; A47B 88/407; A47B 88/75; A47B 88/437; A47B 2200/0035; A47B 2200/09; A47B 13/12
(Continued)

(56) References Cited

U.S. PATENT DOCUMENTS 1,896,346 A * 2/1933 Bolhuis ..... A47B 88/437 312/334.26
2,328,019 A 8/1943 Jones
(Continued)

FOREIGN PATENT DOCUMENTS

CH 309500 * 9/1955
EP 1088498 * 4/2001

OTHER PUBLICATIONS

Office Storage/Filing Cabinets, Saxen Office Furniture Website, Web page <http://www.saxen.co.uk/Office-Storage-Filing-Cabinets>, 1 page, dated Dec. 4, 2013, retrieved from Internet Archive Wayback Machine <https://web.archive.org/web/20131204225807/http://www.saxen.co.uk/Office-Storage-Filing-Cabinets> on Apr. 15, 2019.
(Continued)

*Primary Examiner* — Janet M Wilkens
(74) *Attorney, Agent, or Firm* — The Law Office of Patrick F. O'Reilly III, LLC

(57) ABSTRACT

A desk with a slidable drawer assembly is disclosed herein. The desk includes at least one pair of spaced-apart leg members; a desk tabletop supported on the leg members, the desk tabletop having a top surface and a bottom surface oppositely disposed relative to the top surface; at least one suspended rail member, the at least one suspended rail member supported by the leg members, the at least one suspended rail member being spaced apart from the bottom surface of the desk tabletop by a gap; and a drawer assembly adjustably supported on the at least one suspended rail member, the drawer assembly comprising a support carriage with one or more slidable drawer members, the support carriage configured to be slidably displaced on the at least one suspended rail member so as to enable a user to selectively adjust a position of the drawer assembly of the desk.

17 Claims, 10 Drawing Sheets

(51) Int. Cl.
*A47B 88/75* (2017.01)
*A47B 13/12* (2006.01)
*A47B 88/437* (2017.01)
*A47B 88/407* (2017.01)

(52) U.S. Cl.
CPC ..... *A47B 88/437* (2017.01); *A47B 88/75* (2017.01); *A47B 2200/0035* (2013.01); *A47B 2200/09* (2013.01)

(58) Field of Classification Search
USPC ..... 312/334.1, 330.1, 194–196, 223.3; 108/50.01, 50.02, 26, 25
See application file for complete search history.

(56) References Cited

U.S. PATENT DOCUMENTS 2,471,245 A * 5/1949 Shoenberg ..... A47B 88/407 312/246
2,755,155 A * 7/1956 Luss ..... A47B 17/033 312/198
3,021,185 A * 2/1962 Kowalczyk ..... A47B 13/16 108/26
3,243,246 A * 3/1966 Eversman ..... A47B 17/03 312/194
3,862,789 A 1/1975 Korell et al.
3,920,298 A * 11/1975 Lopez ..... A47B 17/03 312/195
4,176,889 A * 12/1979 Gartung ..... A47B 17/00 108/26
4,180,298 A 12/1979 Borgerson, Jr.
4,427,244 A 1/1984 Castagna
4,600,248 A * 7/1986 Pflieger ..... A47B 17/00 312/195
4,637,666 A * 1/1987 Worrell ..... A47B 21/03 312/196
4,660,905 A * 4/1987 Conner ..... A47B 17/00 248/525
5,623,881 A * 4/1997 Huang ..... A47B 21/00 108/102
6,189,844 B1 * 2/2001 Chang ..... A47B 13/003 248/176.1
6,302,035 B1 * 10/2001 Frenkler ..... A47B 13/003 108/102
9,745,786 B2 8/2017 Andren et al.
2002/0040668 A1 * 4/2002 Pang Chan ..... A47B 17/003 108/157.1
2002/0053862 A1 * 5/2002 Visser ..... A47B 21/007 312/223.3
2003/0020381 A1 * 1/2003 Cattaneo ..... A47B 21/06 312/223.6
2004/0194670 A1 * 10/2004 Lai ..... A47B 21/00 108/50.02
2005/0012007 A1 * 1/2005 Chang ..... A47B 21/0314 248/298.1
2007/0012841 A1 * 1/2007 Chen ..... A47B 21/0314 248/298.1
2007/0126319 A1 6/2007 Bauer et al.
2012/0217858 A1 * 8/2012 Lai ..... A47B 17/00 312/334.5
2018/0279770 A1 * 10/2018 Crowe ..... A47B 9/16

OTHER PUBLICATIONS

All Products, Winsoon Website, Web page <http://www.winsoonhardware.com/index.php?route=product/category&path=4>, 1 page, dated Dec. 16, 2016, retrieved from Internet Archive Wayback Machine <https://web.archive.org/web/20161216164945/http://www.winsoonhardware.com/index.php?route=product/category&path=4> on Apr. 15, 2019.

* cited by examiner

Assembly A

Detail A

DESK WITH SLIDABLE DRAWER ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a desk with a slidable drawer assembly. More particularly, the invention relates to a desk with a drawer assembly that is able to be selectively positioned by a user.

2. Background

Conventional desks are well known in the art. Conventional desks often have one or more drawers disposed underneath the top panels of the desks for storing various office supplies, such as writing utensils, etc. However, these one or more drawers are typically positioned in a fixed location underneath the desk top panel, which may interfere with the manner in which a user wishes to use the desk. For example, a user may wish to position his or her legs under a particular end portion of the desk, but the user is unable to do so because the one or more drawers of the desk occupy the leg space of the desk. As such, because of the fixed location of the one or more drawers in a conventional desk, the user of the desk is not able to enjoy the flexibility of using the desk in the manner in which he or she so desires.

Therefore, what is needed is a desk with a slidable drawer assembly that is able to be selectively positioned by a user so that the user is able to more flexibly use the desk in the manner desired by the user. Moreover, a desk is needed that has an easily adjustable drawer assembly so that a user can position the drawer assembly in the location that he or she desires without manipulating fasteners or engaging in a complex adjustment process. Furthermore, a desk with a slidable drawer assembly is needed that enhances user comfort and/or customization by allowing the user to selectively adjust the position of the drawer assembly in a particular location underneath the desktop so that the user is able to position his or her legs in the desired location underneath the desk without being obstructed by the drawer assembly.

BRIEF SUMMARY OF EMBODIMENTS OF THE INVENTION

Accordingly, the present invention is directed to a desk with a slidable drawer assembly that substantially obviates one or more problems resulting from the limitations and deficiencies of the related art.

In accordance with one or more embodiments of the present invention, there is provided a desk with a slidable drawer assembly that includes at least one pair of leg members, a first of the at least one pair of leg members being spaced apart from a second of the at least one pair of leg members; a desk tabletop supported on the at least one pair of leg members, the desk tabletop having a top surface and a bottom surface oppositely disposed relative to the top surface; at least one suspended rail member, the at least one suspended rail member supported by the at least one pair of leg members, the at least one suspended rail member being spaced apart from the bottom surface of the desk tabletop by a gap; and a drawer assembly adjustably supported on the at least one suspended rail member, the drawer assembly comprising a support carriage with one or more slidable drawer members, the support carriage configured to be slidably displaced on the at least one suspended rail member so as to enable a user of the desk to selectively adjust a position of the drawer assembly of the desk.

In a further embodiment of the present invention, at least one of the leg members comprises intersecting diagonal members with a central rectangular member circumscribing the intersection point of the diagonal members.

In yet a further embodiment, the desk tabletop comprises a glass panel supported on a tabletop frame, the tabletop frame being coupled to the at least one pair of the leg members.

In still a further embodiment, the at least one suspended rail member comprises a first suspended rail member and a second suspended rail member, the first suspended rail member being laterally spaced apart from the second suspended rail member, and the support carriage of the drawer assembly being adjustably supported on the first and second suspended rail members.

In yet a further embodiment, the first and second suspended rail members are supported between the leg members of the desk.

In still a further embodiment, each of the first and second suspended rail members has a circular cross section.

In yet a further embodiment, the drawer assembly further comprises at least one roller, the at least one roller slidably coupling the drawer assembly to the at least one suspended rail member.

In still a further embodiment, the at least one roller of the drawer assembly comprises a concave surface that substantially corresponds to a curved outer surface of the at least one suspended rail member.

In yet a further embodiment, the support carriage of the drawer assembly comprises a pair of side frame members, at least one pair of drawer frame members, and a bottom wall, the at least one pair of drawer frame members operating as tracks for the one or more slidable drawer members.

In still a further embodiment, the one or more slidable drawer members of the drawer assembly comprise a first slidable drawer member and a second slidable drawer member, the first slidable drawer member being disposed above the second slidable drawer member.

In accordance with one or more other embodiments of the present invention, there is provided a desk with a slidable drawer assembly that includes at least one pair of leg members, a first of the at least one pair of leg members being spaced apart from a second of the at least one pair of leg members; a desk tabletop supported on the at least one pair of leg members, the desk tabletop having a top surface and a bottom surface oppositely disposed relative to the top surface; first and second suspended rail members, the first suspended rail member being laterally spaced apart from the second suspended rail member, the first and second rail members supported by the at least one pair of leg members, the first suspended rail member being spaced apart from the bottom surface of the desk tabletop by a first gap, and the second suspended rail member being spaced apart from the bottom surface of the desk tabletop by a second gap; and a drawer assembly adjustably supported on the first and second suspended rail members, the drawer assembly comprising a support carriage with one or more slidable drawer members, the support carriage configured to be slidably displaced on the first and second suspended rail members so as to enable a user of the desk to selectively adjust a position of the drawer assembly of the desk.

In a further embodiment of the present invention, at least one of the leg members comprises intersecting diagonal members with a central rectangular member circumscribing the intersection point of the diagonal members.

In yet a further embodiment, the desk tabletop comprises a glass panel supported on a tabletop frame, the tabletop frame being coupled to the at least one pair of the leg members.

In still a further embodiment, the first gap between the first suspended rail member and the bottom surface of the desk tabletop is substantially equal to the second gap between the second suspended rail member and the bottom surface of the desk tabletop.

In yet a further embodiment, the first and second suspended rail members are supported between the leg members of the desk.

In still a further embodiment, each of the first and second suspended rail members has a circular cross section.

In yet a further embodiment, the drawer assembly further comprises at least one roller, the at least one roller slidably coupling the drawer assembly to the at least one suspended rail member.

In still a further embodiment, the at least one roller of the drawer assembly comprises a concave surface that substantially corresponds to a curved outer surface of the at least one suspended rail member.

In yet a further embodiment, the support carriage of the drawer assembly comprises a pair of side frame members, at least one pair of drawer frame members, and a bottom wall, the at least one pair of drawer frame members operating as tracks for the one or more slidable drawer members.

In still a further embodiment, the one or more slidable drawer members of the drawer assembly comprise a first slidable drawer member and a second slidable drawer member, the first slidable drawer member being disposed above the second slidable drawer member.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
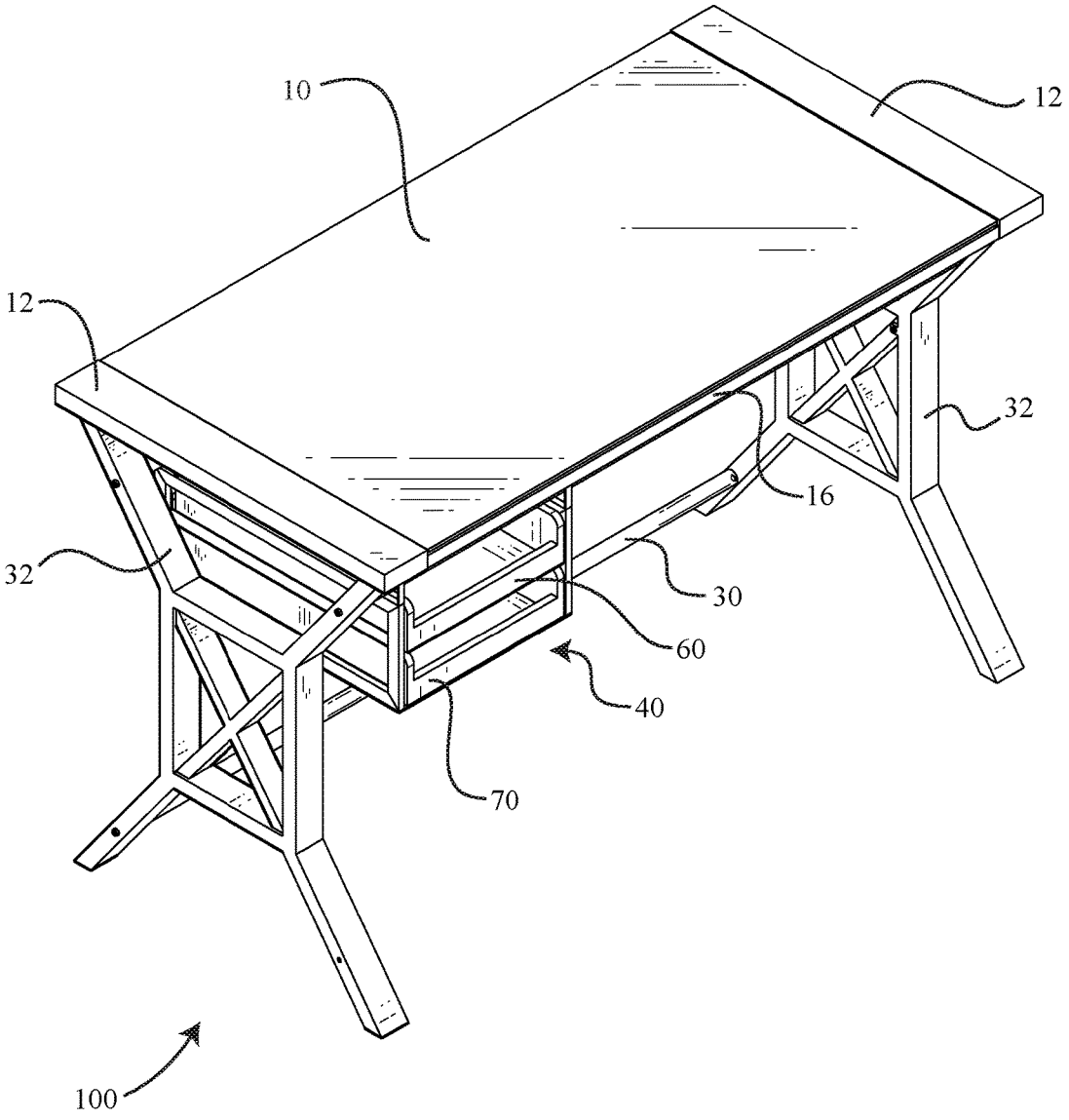
FIG. 1 is a left-front perspective view of a desk with a slidable drawer assembly, according to an illustrative embodiment of the invention.

An illustrative embodiment of a desk 100 with a slidable drawer assembly 40 is shown in FIGS. 1-8, 11, and 12. Initially, referring to FIGS. 1-3, it can be seen that the illustrative desk 100 generally comprises a pair of leg structures or leg members 32, a first of the pair of leg members 32 being spaced apart from a second of the leg members 32 (i.e., right and left leg members 32); a desk tabletop 10, 12, 16 supported on the pair of leg members 32, the desk tabletop 10, 12, 16 having a top surface and a bottom surface oppositely disposed relative to the top surface (e.g., top and bottom surfaces of glass panel 10); first and second suspended rail members 22, the first suspended rail member 22 being laterally spaced apart from the second suspended rail member 22 (see FIG. 12), the first and second rail members 22 supported by the pair of leg members 32, the first suspended rail member 22 being spaced apart from the bottom surface of the desk tabletop 10, 12, 16 by a first gap (see FIGS. 3 and 4), and the second suspended rail member 22 being spaced apart from the bottom surface of the desk tabletop 10, 12, 16 by a second gap (see FIGS. 3 and 4); and a drawer assembly 40 adjustably supported on the first and second suspended rail members 22, the drawer assembly 40 comprising a support carriage 42, 44, 50, 80, 82 with a plurality of slidable drawer members 60, 70, the support carriage 42, 44, 50, 80, 82 configured to be slidably displaced on the first and second suspended rail members 22 so as to enable a user of the desk to selectively adjust a position of the drawer assembly of the desk (refer to different positions of drawer assembly 40 in FIGS. 11 and 12).

Figure 8:
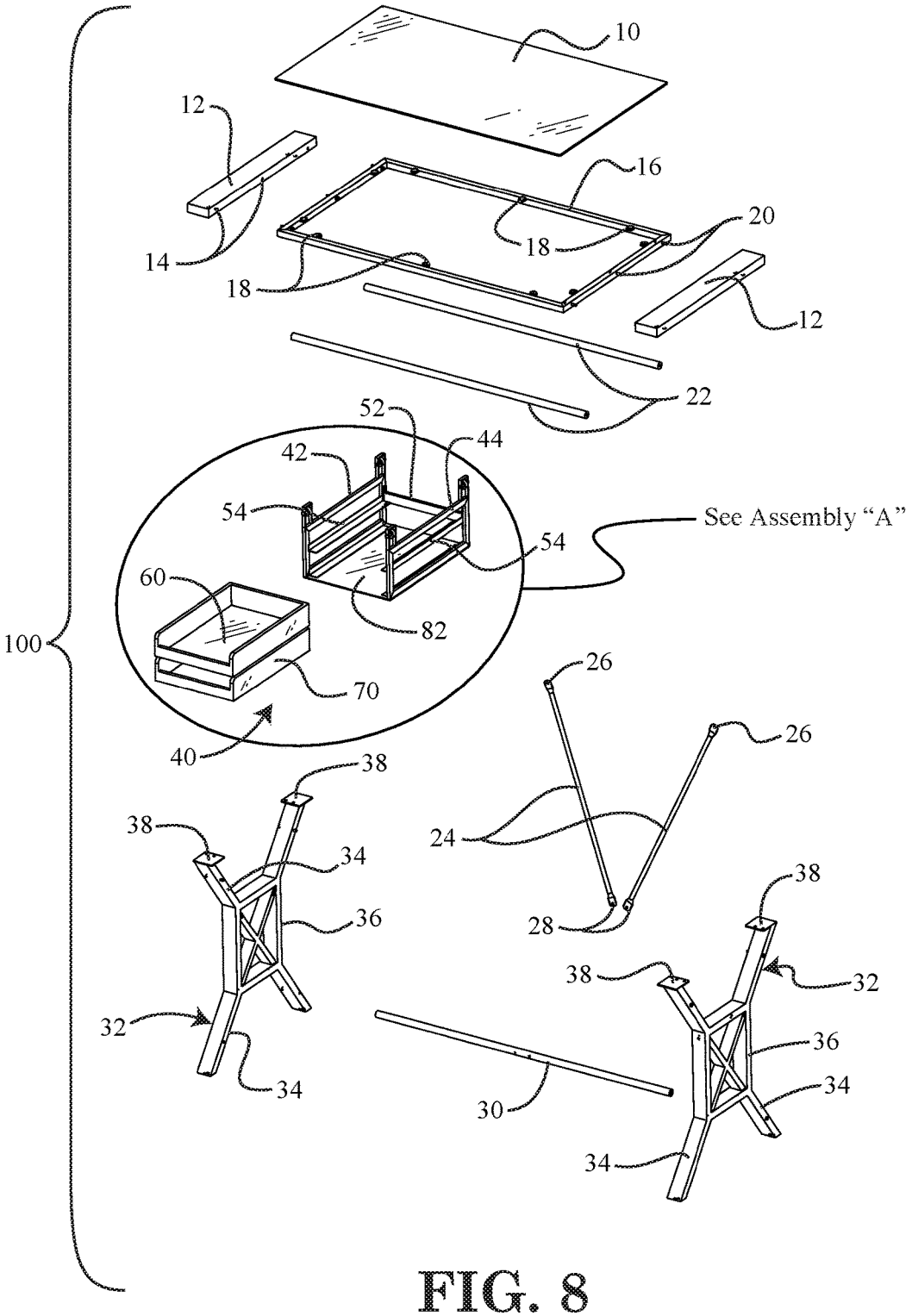
FIG. 8 is an exploded perspective view of the desk of FIG. 1.

Referring particularly to the exploded view of FIG. 8, the features of the illustrative leg structures or leg members 32 of the desk 100 will be described in detail. As shown in FIG. 8, in the illustrative embodiment, each leg member 32 comprises intersecting diagonal members 34 with a central rectangular member 36 circumscribing the intersection point of the diagonal members 34. That is, in the illustrated embodiment, the intersecting diagonal members 34 form an X-shaped leg structure with the rectangular member 36 circumscribing the central intersection location of the leg members 32. Also, as shown in the illustrative embodiment of FIG. 8, the top end of each diagonal member 34 may comprise a top mounting plate 38 for securing the leg member 32 to the desk tabletop 10, 12, 16, particularly to a respective side tabletop member 12, as will be described hereinafter. For example, in the illustrative embodiment, each top mounting plate 38 may comprise a plurality of fastener apertures for receiving fasteners (e.g., screws) to secure leg members 32 to the side tabletop members 12.

In one or more embodiments, the central portions of the diagonal members 34 (i.e., within the extents of the central rectangular member 36) may be formed from components that are separate from a component forming the top and bottom portions of the diagonal members 34 (i.e., outside the extents of the central rectangular member 36). For example, in these one or more embodiments, the top and bottom portions of the diagonal members may be formed a one-piece metal component and the diagonal members within the central rectangular member may be formed from separate wood components that are attached to the one-piece metal component.

In alternative embodiments, rather than being provided with a pair of X-shaped leg members 32 at each of the longitudinal ends of the desk 100, it is to be understood that the desk 100 alternatively may be provided with different leg structures, such as four (4) post-type legs (e.g., with one leg in each corner of the desk 100).

Turning again to the exploded view of FIG. 8, the features of the illustrative desk tabletop 10, 12, 16 of the desk 100 will be explained. As depicted in FIG. 8, in the illustrative embodiment, the desk tabletop 10, 12, 16 comprises a glass panel 10 supported on a tabletop frame 16 with side tabletop members 12 attached to the oppositely disposed longitudinal ends of the tabletop frame 16. In FIG. 8, it can be seen that the tabletop frame 16 comprises a rectangular annular frame structure with supporting projections extending from the inner peripheral surface of the frame 16. In the illustrative embodiment, each of the supporting projections is provided with a circular compressible pad 18 (e.g., a compressible rubber pad) disposed on the top surface thereof for supporting glass panel 10 on the peripheral frame 16. Advantageously, in the illustrative embodiment, the circular compressible pads 18 support the glass panel 10 on the peripheral frame 16 without scratching the bottom surface of the glass panel 10. Referring again to FIG. 8, it can be seen that the longitudinal ends of the tabletop frame 16 are provided with a plurality of cylindrical bosses 20 protruding therefrom (e.g., three (3) bosses 20 on each end) for attaching the side tabletop members 12 to the longitudinal ends of the tabletop frame 16. In the illustrative embodiment of FIG. 8, it can be seen that the inner side of each side tabletop member 12 is provided with a plurality of circular recesses 14 that correspond to the cylindrical bosses 20 protruding from the ends of the tabletop frame 16 (i.e., the cylindrical bosses 20 are inserted into the circular recesses 14 to attach the side tabletop members 12 to the tabletop frame 16). In the illustrative embodiment, the tabletop frame 16 is coupled to the pair of the leg members 32 by means of the side tabletop members 12. The side tabletop members 12 are secured to the top ends of the leg members 32 by fasteners securing the top mounting plates 38 of the legs 32 to the bottom surfaces of the side tabletop members 12.

Figure 2:
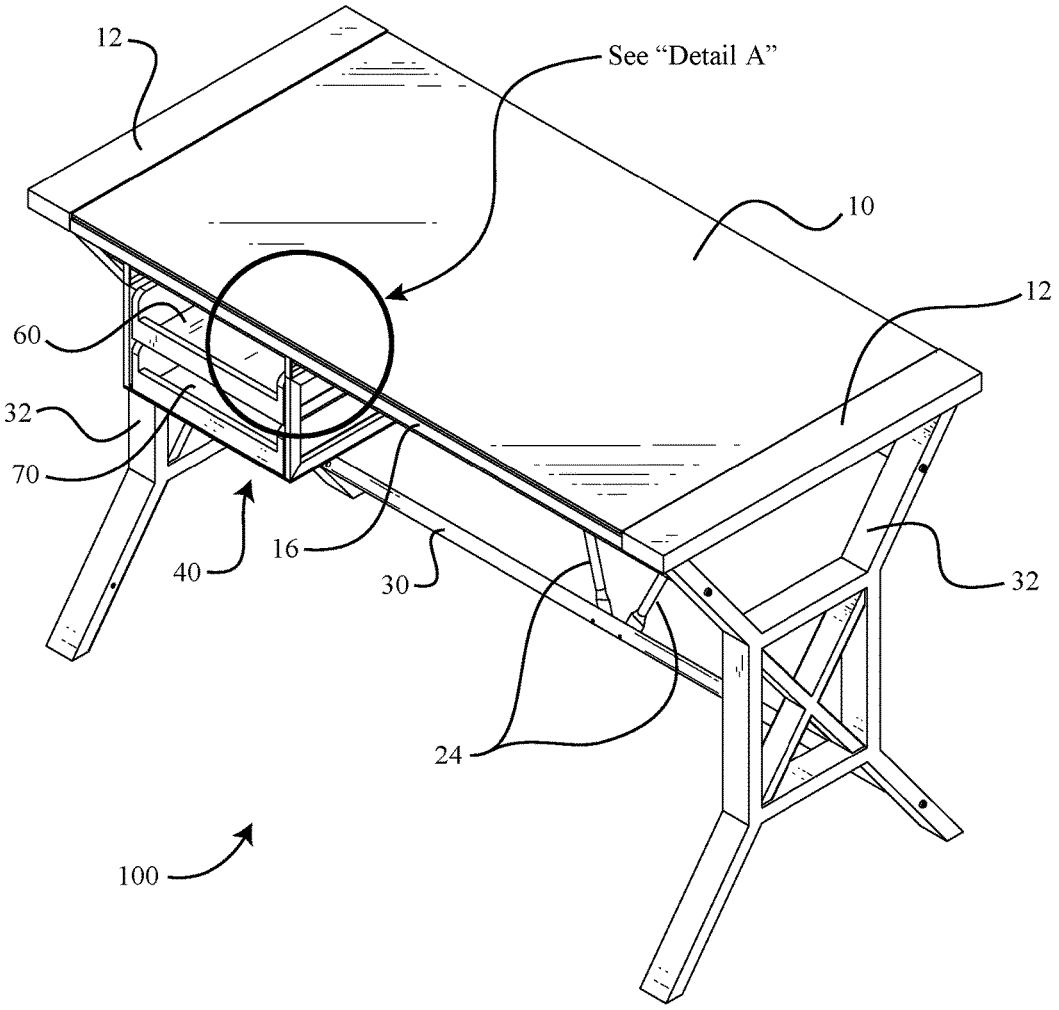
FIG. 2 is a front-right perspective view of the desk of FIG. 1.
Figure 3:
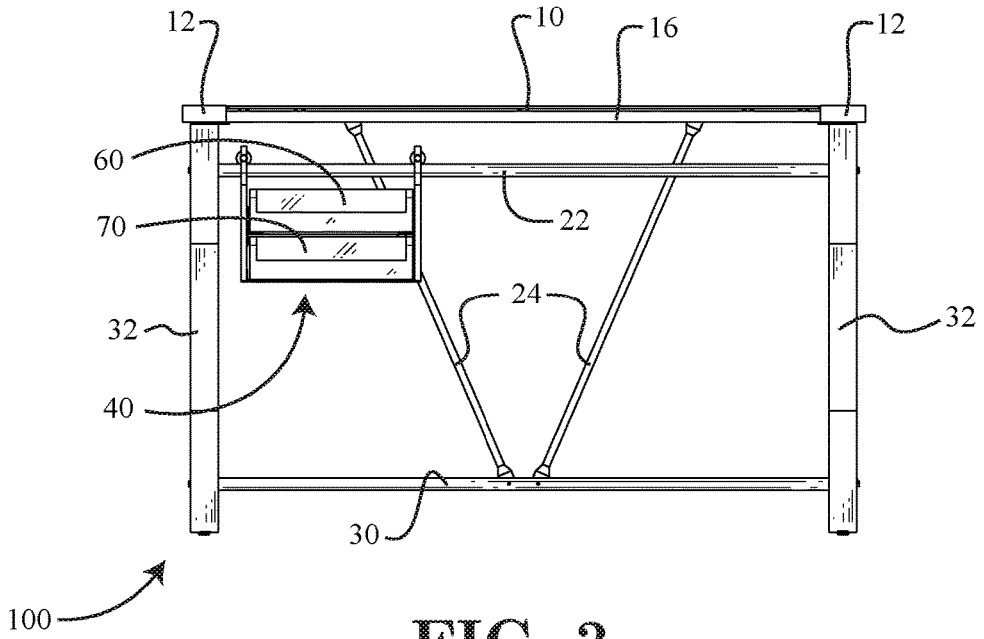
FIG. 3 is a front elevational view of the desk of FIG. 1.
Figure 4:
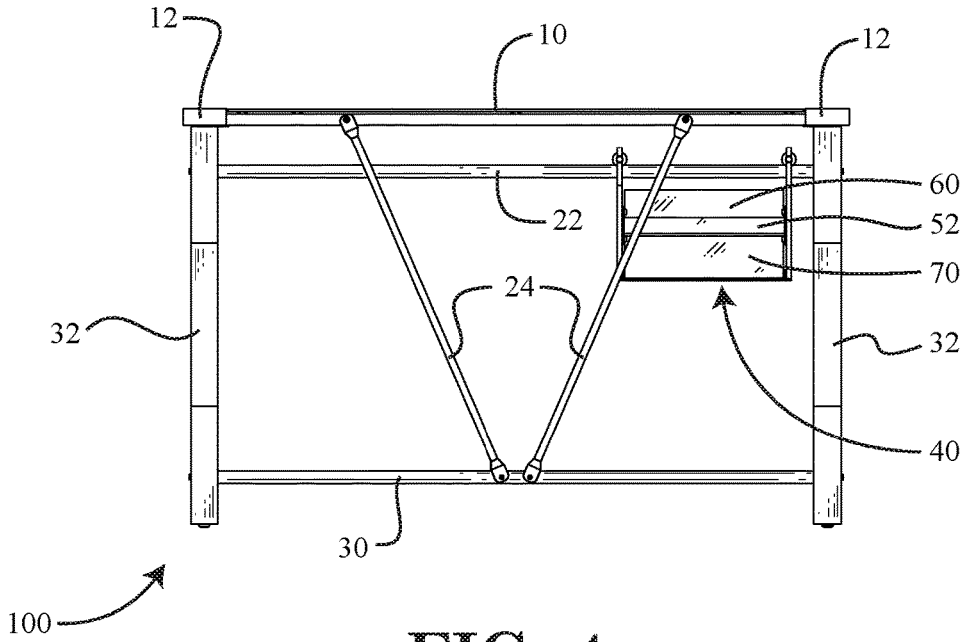
FIG. 4 is a rear elevational view of the desk of FIG. 1.
Figure 5:
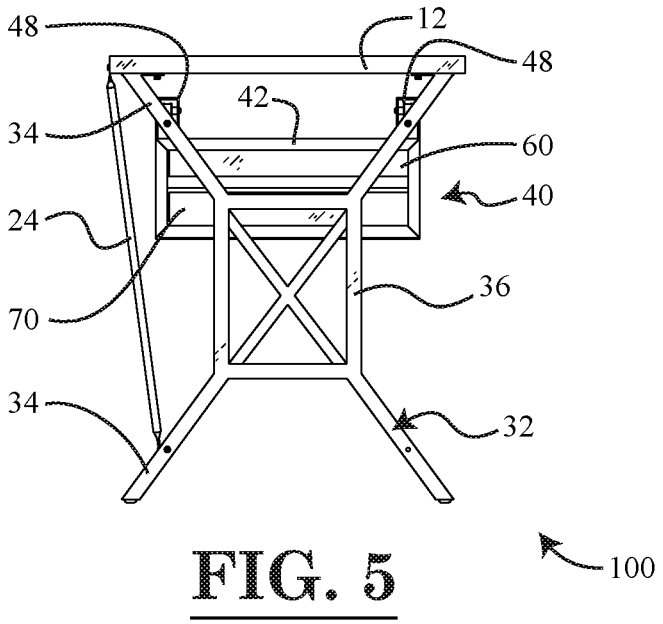
FIG. 5 is a first end elevational view of the desk of FIG. 1.
Figure 6:
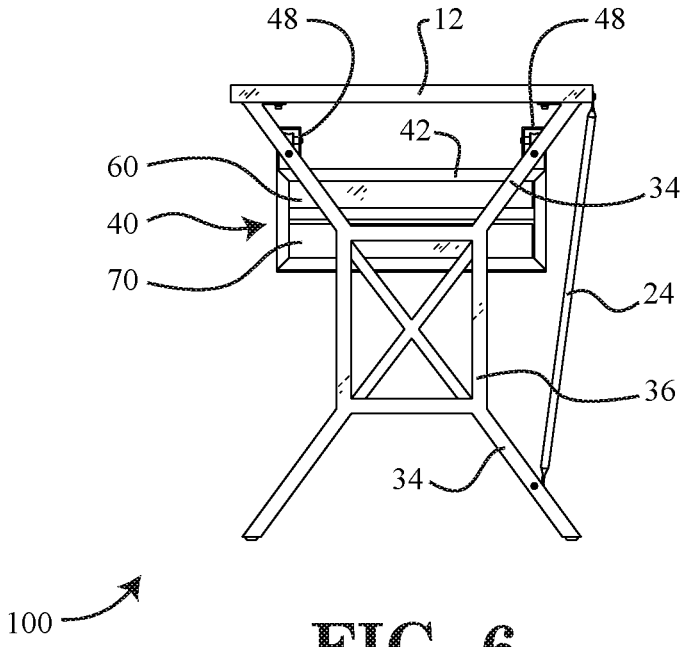
FIG. 6 is a second end elevational view of the desk of FIG. 1.
Figure 7:
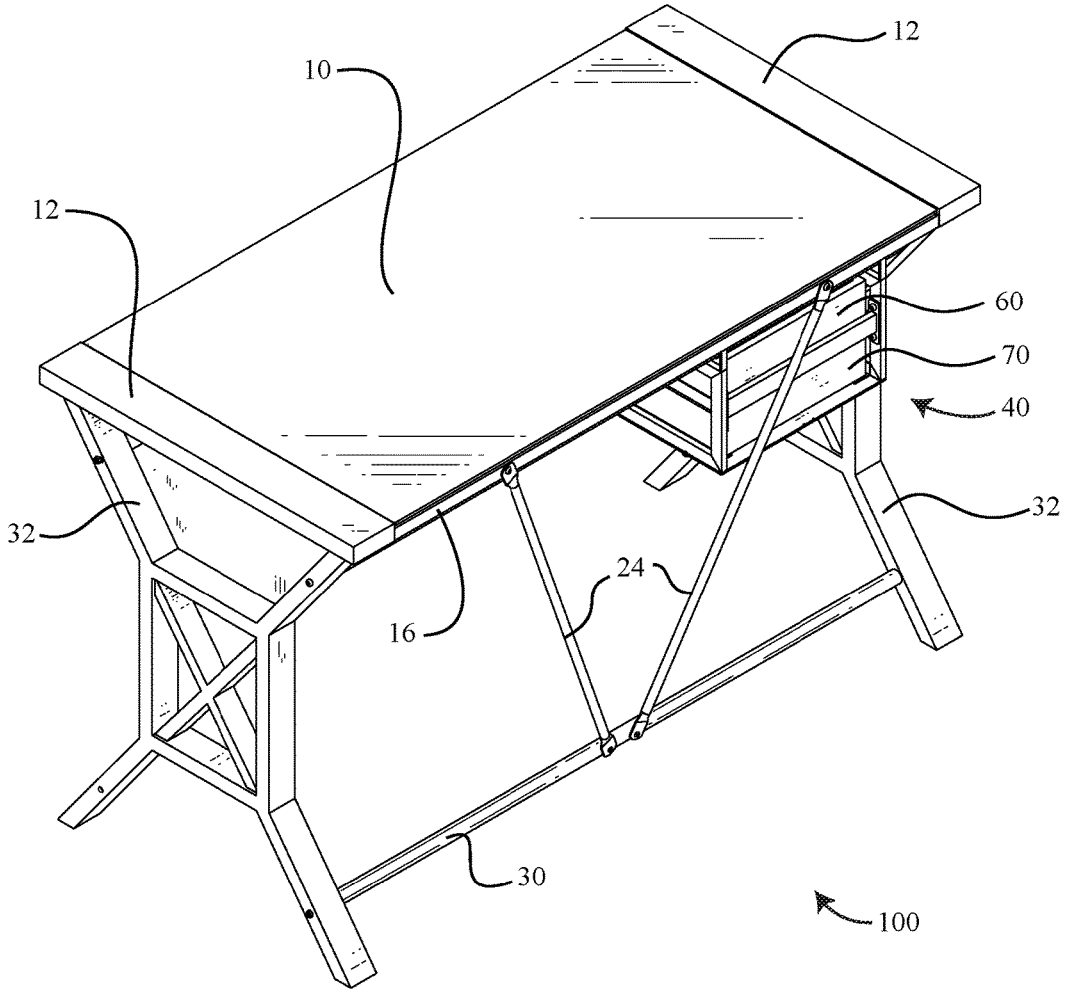
FIG. 7 is a right-rear perspective view of the desk of FIG. 1.

As shown in the illustrative embodiment of FIGS. 1-6, to increase the structural rigidity of the desk 100, the desk 100 may be provided with a rear longitudinal support member 30 that extends between the leg members 32, and a pair of rear support strut members 24 that are connected between the rear longitudinal support member 30 and the rear longitudinal side of the tabletop frame 16. More specifically, with combined reference to the illustrative embodiment depicted in FIGS. 4 and 8, the lower end 28 of each strut member 24 is attached to the longitudinal support member 30 (e.g., by a fastener in the form of a screw), and the upper end 26 of each strut member 24 is attached to the rear longitudinal side of the tabletop frame 16 (e.g., by a fastener in the form of a screw). As shown in FIG. 4, the strut member 24 may be arranged in a V-configuration so as to add structural rigidity to the desk 100. As shown in FIGS. 1 and 2, longitudinal support member 30 is attached to the rear bottom portions of the leg diagonal members 34 in the illustrative embodiment (e.g., by fasteners in the form of a screws).

Figure 9:
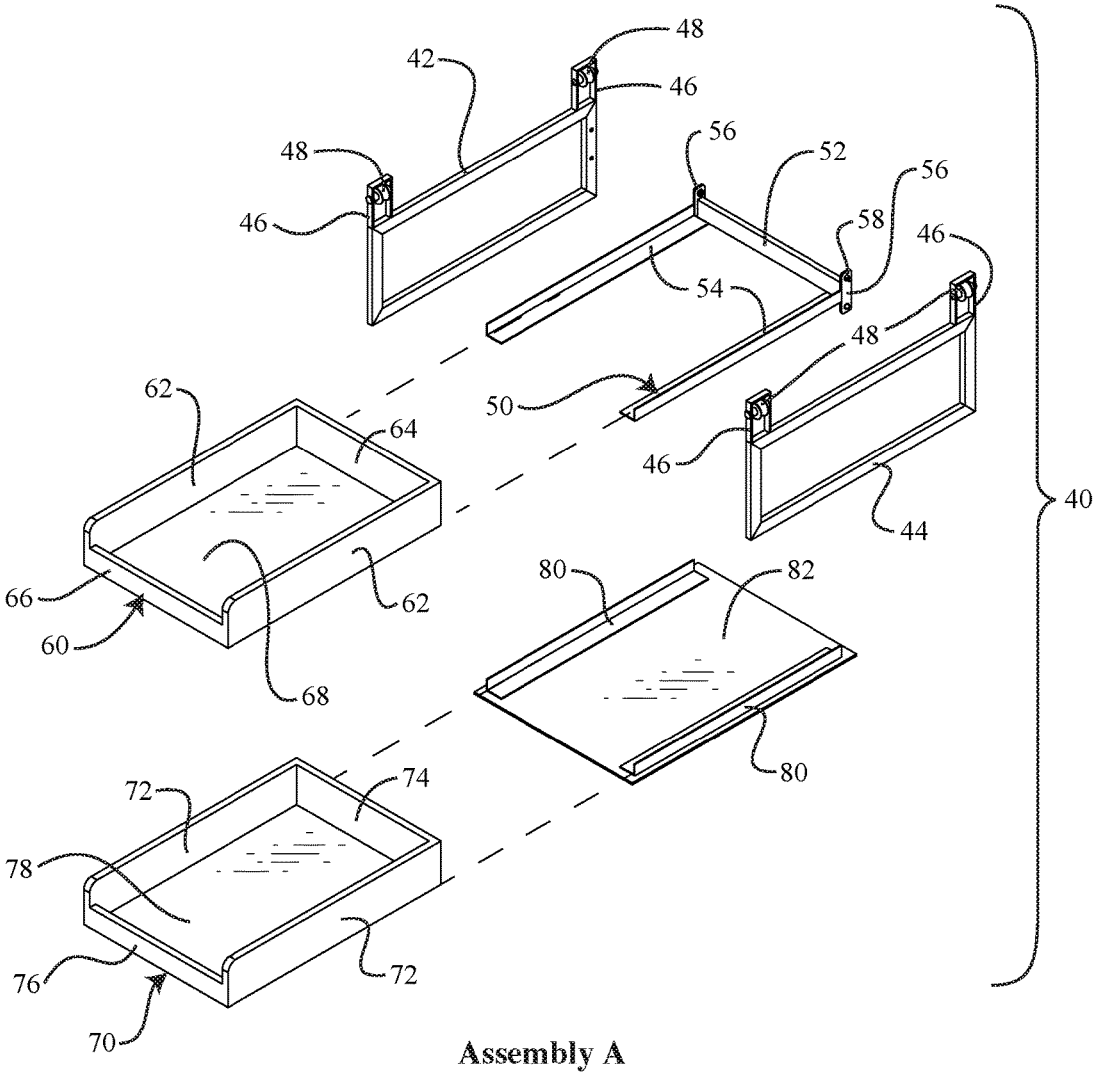
FIG. 9 is an exploded perspective view of the drawer assembly of the desk of FIG. 1.

Now, with reference primarily to FIGS. 8-12, the slidable drawer assembly 40 of the illustrative desk 100 will be described in detail. As best shown in FIGS. 8 and 9, in the illustrative embodiment, the support carriage of the slidable drawer assembly 40 generally comprises a pair of side frame members 42, 44, upper and lower drawer frame members 50, 80, and a bottom wall or panel 82. The upper and lower drawer frame members 50, 80 operate as tracks for the slidable drawer members 60, 70. More specifically, with reference to the illustrative embodiment depicted in FIG. 9, each of the side frame members 42, 44 of the support carriage of the slidable drawer assembly 40 is in the form of a rectangular annular frame member with a pair of rollers 48 mounted to the top of each frame member 42, 44 by roller brackets 46. Referring again to FIG. 9, it can be seen that the upper drawer frame member 50 comprises a rear frame portion 52 and a pair of side frame portions 54 attached to the rear frame portion 52. In the illustrative embodiment, the upper drawer frame member 50 further comprises a pair of oppositely disposed side mounting plates 56, which are provided with a plurality of cylindrical fastener bosses 58 for securing the upper drawer frame member 50 to the side frame members 42, 44 (e.g., as shown in FIG. 9, each side frame member 42, 44 may be provided with circular recesses that correspond to the cylindrical fastener bosses 58 of the mounting plates 56). Also, as shown in the illustrative embodiment of FIG. 9, the lower drawer frame members 80 may be attached to the bottom wall 82 of the support carriage, and then the bottom wall 82 of the support carriage may be secured to the bottom surface of each annular frame member 42, 44. In the illustrative embodiment, the side frame portions 54 of the upper drawer frame member 50 and the lower drawer frame members 80 may each have a L-shaped cross section so as to form side track members for the upper and lower slidable drawers 60, 70.

Figure 10:
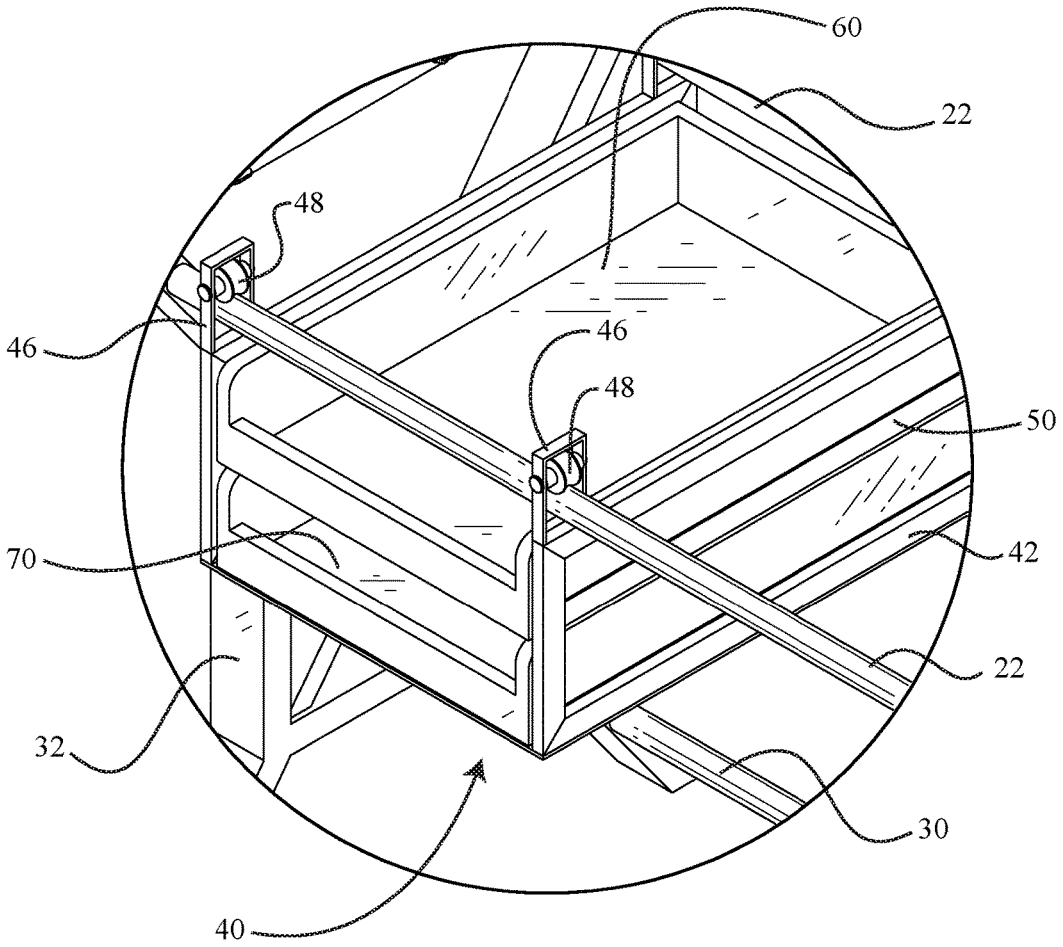
FIG. 10 is an enlarged, partial perspective view of the drawer assembly of the desk of FIG. 1 (Detail "A")

Turning again to the illustrative embodiment of FIGS. 9 and 10, it can be seen that the drawer assembly 40 comprises a first slidable upper drawer member 60 and a second slidable lower drawer member 70. The first slidable upper drawer member 60 is elevated above the second slidable lower drawer member 70 by the upper drawer frame member 50. In the illustrative embodiment, the slidable upper drawer member 60 comprises a pair of sidewalls 62, a rear wall 64, a front wall 66, and a horizontal bottom wall 68 attached to the peripheral upstanding walls 62, 64, 66. The parallel front and rear walls 64, 66 of the upper drawer member 60 are attached to, and disposed approximately perpendicular to the pair of parallel sidewalls 62 of the upper drawer member 60. In the illustrative embodiment, the front wall 66 of the upper drawer member 60 has a height that is less than the rear wall 64, which allows papers or office supplies to be placed in the upper drawer member 60 without sliding the drawer 60 out from the support carriage of the slidable drawer assembly 40. Similarly, in the illustrative embodiment, the slidable lower drawer member 70 comprises a pair of sidewalls 72, a rear wall 74, a front wall 76, and a horizontal bottom wall 78 attached to the peripheral upstanding walls 72, 74, 76. The parallel front and rear walls 74, 76 of the lower drawer member 70 are attached to, and disposed approximately perpendicular to the pair of parallel sidewalls 72 of the lower drawer member 70. Similar to the upper drawer member 60, in the illustrative embodiment, the front wall 76 of the lower drawer member 70 has a height that is less than the rear wall 74, which allows papers or office supplies to be placed in the lower drawer member 70 without sliding the drawer 70 out from the support carriage of the slidable drawer assembly 40. In the illustrative embodiment, the upper and lower drawer members 60, 70 are each in the form of a tray that is able to be slid in and out of the support carriage of the slidable drawer assembly 40. The partial height front walls 66, 76 of the upper and lower drawer members 60, 70 may be grasped by a user when pulling each of the drawer members 60, 70 out from the support carriage of the slidable drawer assembly 40 (i.e., the partial height front walls 66, 76 operate as handles for facilitating the pulling of the drawer members 60, 70 out of the support carriage of the slidable drawer assembly 40).

Figure 11:
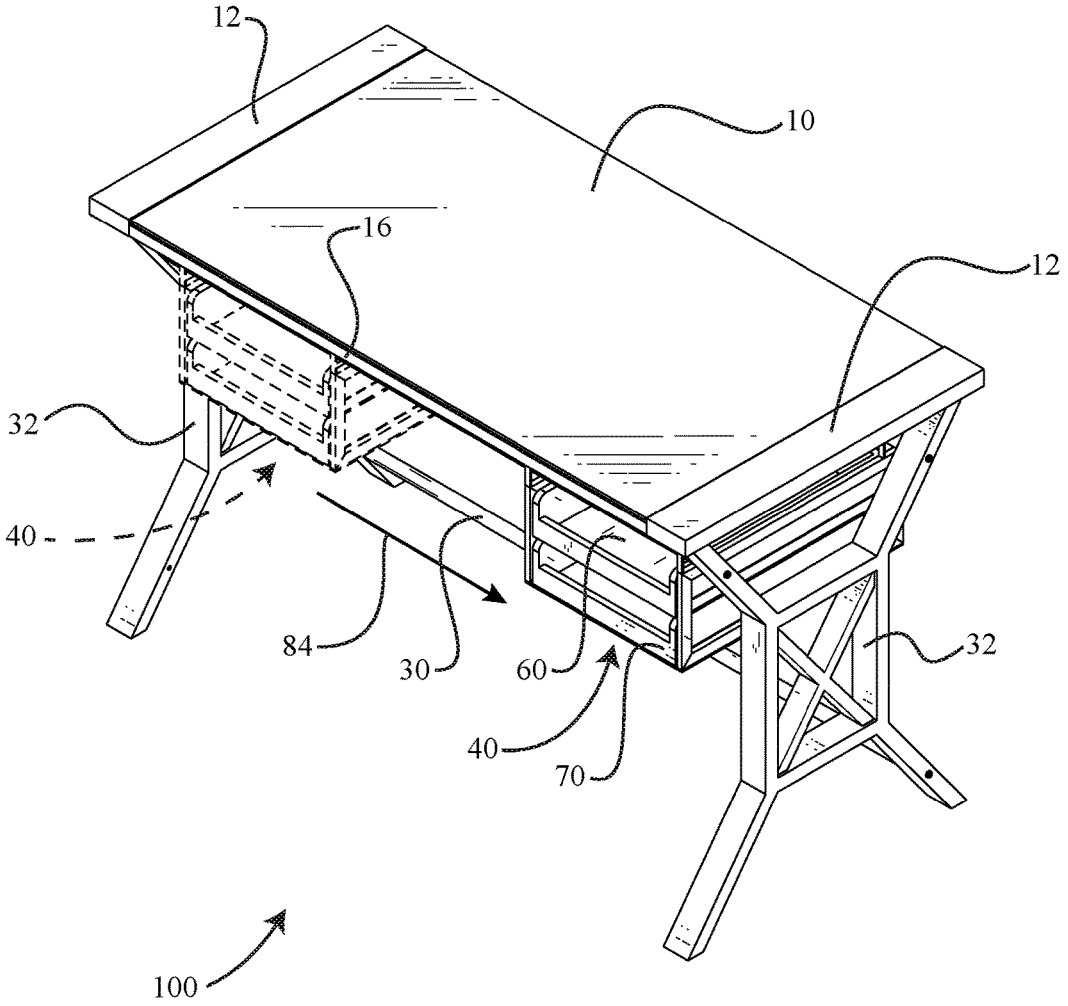
FIG. 11 is another front-right perspective view of the desk of FIG. 1, wherein the adjustability of the drawer assembly is illustrated.
Figure 12:
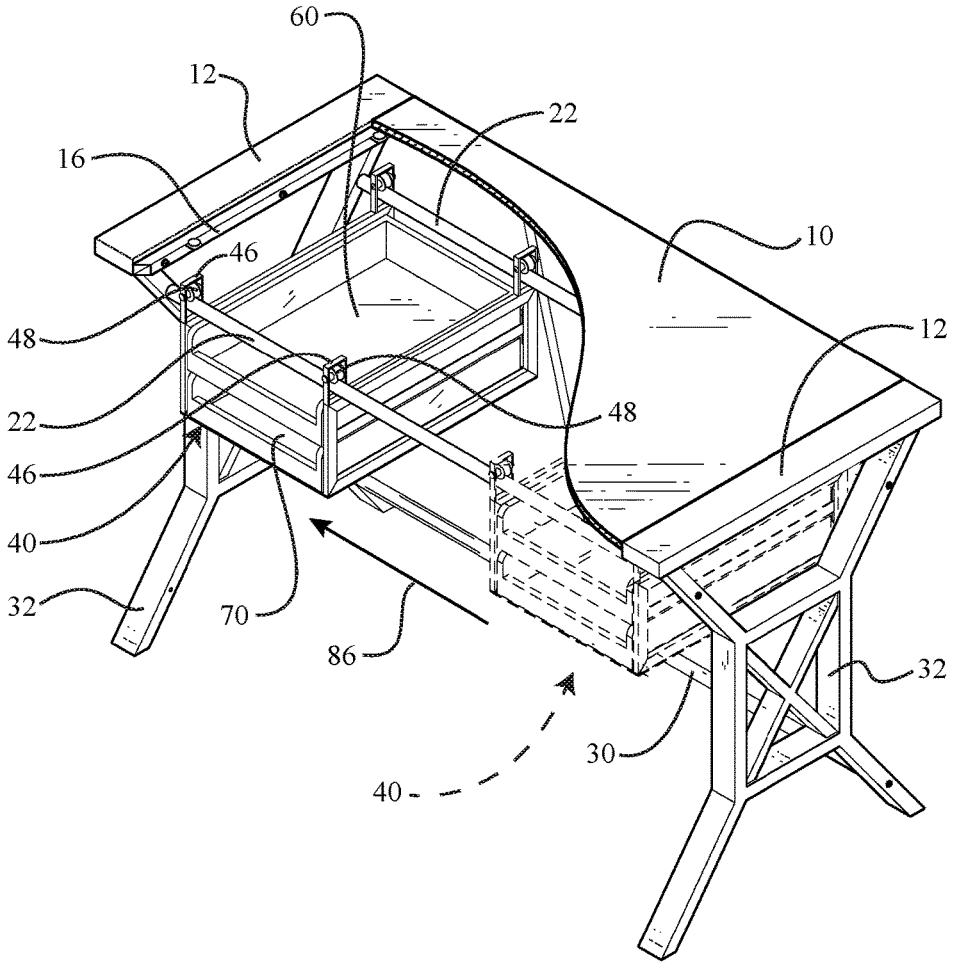
FIG. 12 is a cutaway front-right perspective view of the desk of FIG. 1, wherein the adjustability of the drawer assembly is illustrated.

Next, with reference primarily to FIGS. 10-12, the adjustability of the drawer assembly 40 of the illustrative desk 100 will be described. As best shown in the cutaway perspective view of FIG. 12, the drawer assembly 40 is suspension-mounted from the pair of rail members 22 in a slidable manner so that drawer assembly 40 is able to be linearly translated back-and-forth on the rail members 22 in a longitudinal direction of the desk 100. For example, as shown in FIG. 11, the drawer assembly 40 may be translated to the right end of the desk 100 along the rail members 22 (as diagrammatically indicated by the arrow 84 in FIG. 11) if a user wants to position the drawer assembly 40 on the right side of the desk 100. Conversely, as shown in FIG. 12, the drawer assembly 40 may be translated to the left end of the desk 100 along the rail members 22 (as diagrammatically indicated by the arrow 86 in FIG. 12) if a user wants to position the drawer assembly 40 on the left side of the desk 100. In addition to the rightmost and leftmost positions of the drawer assembly 40 depicted in FIGS. 11 and 12, it is to be understood that the drawer assembly 40 may also be selectively positioned in any intermediate position by the user between the rightmost and leftmost positions depicted in FIGS. 11 and 12, respectively. After the user has slid the drawer assembly 40 to its desired position on the rail members 22 of the desk 100, the frictional engagement between the rollers 48 and the rail members 22 maintains the selected position of the drawer assembly 40.

In the illustrative embodiment, as shown in FIGS. 3, 4, and 12, the suspended rail members 22 are mounted at substantially the same height on the leg members 32 of the desk 100 such that the suspended rail members 22 are co-planar to one another (i.e., disposed in the same horizontal plane) and the suspended rail members 22 have longitudinal axes that are disposed generally parallel to one another. As such, in the illustrative embodiment, the first gap between the first suspended rail member 22 and the bottom surface of the glass panel 10 of desk tabletop 10, 12, 16 is substantially equal to the second gap between the second suspended rail member 22 and the bottom surface of the desk tabletop 10, 12, 16. In the illustrative embodiment, the first and second suspended rail members 22 are supported from, and between the leg members 32 of the desk 100 (i.e., the end of each rail member 22 is mounted to inner side surface of one of the leg members 32. Further, in the illustrative embodiment, the suspended rail members 22 each have a circular cross section (e.g., the suspended rail members 22 are each in the form of cylindrical tubular members). As such, in the illustrative embodiment, each of the rollers 48 of the drawer assembly 40 comprises a concave surface that substantially corresponds to a curved outer surface of the circular cross section of the suspended rail members 22. As best shown in FIGS. 9 and 10, the roller mounting brackets 46 of the illustrative embodiment are in the form of inverted U-shaped bracket members with the lower ends of the inverted U-shaped bracket members being welded, or otherwise attached, to the top of the frame members 42, 44. In the illustrative embodiment, the rotational axis of each roller 48 is attached to oppositely disposed sides of the inverted U-shaped roller bracket 46. As shown in FIG. 10, in the installed state of the drawer assembly 40, the cross-section of the suspended rail members 22 is circumscribed by the inverted U-shaped roller brackets 46, rollers 48, and the frame members 42, 44 such that drawer assembly 40 cannot be removed from the suspended rail members 22 unless the suspended rail members 22 are disengaged from the leg members 32.

In an example embodiment, the majority of the components of the desk 100 may be formed from a suitable metal, such as steel, except that the side tabletop members 12 and the drawer members 60, 70 may be formed from wood, and the rollers 48 may be formed from a suitable polymeric material, plastic or rubber. Also, the other components, such as the top panel 10 and the pads 18, may be formed from the example materials described above.

It is readily apparent that the aforedescribed desk 100, which is provided with the slidable drawer assembly 40, offers numerous advantages. First of all, as described above, the slidable drawer assembly 40 of the desk 100 is able to be selectively positioned by a user so that the user is able to more flexibly use the desk 100 in the manner desired by the user. Secondly, the slidable drawer assembly 40 of the desk 100 is easily adjustable so that a user can position the drawer assembly 40 in the location that he or she desires without manipulating fasteners or engaging in a complex adjustment process. Finally, the aforedescribed desk 100 with the slidable drawer assembly 40 enhances user comfort and/or customization by allowing the user to selectively adjust the position of the drawer assembly 40 in a particular location underneath the desktop 10, 12, 16 so that the user is able to position his or her legs in the desired location underneath the desk without being obstructed by the drawer assembly 40.

Any of the features or attributes of the above described embodiments and variations can be used in combination with any of the other features and attributes of the above described embodiments and variations as desired. Also, as it is used throughout this disclosure, the conjunction "and/or" means one, or the other, or both.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A desk with a slidable drawer assembly, the desk comprising:

at least one pair of leg members, a first of the at least one pair of leg members being spaced apart from a second of the at least one pair of leg members;

a desk tabletop supported on the at least one pair of leg members, the desk tabletop having a top surface and a bottom surface oppositely disposed relative to the top surface;

at least one suspended rail member, the at least one suspended rail member supported by the at least one pair of leg members, the at least one suspended rail member being spaced apart from the bottom surface of the desk tabletop by a gap; and a drawer assembly adjustably supported on the at least one suspended rail member, the drawer assembly comprising a support carriage with one or more slidable drawer members, the support carriage configured to be slidably displaced on the at least one suspended rail member so as to enable a user of the desk to selectively adjust a position of the drawer assembly of the desk, the drawer assembly further comprising at least one roller, the at least one roller slidably coupling the drawer assembly to the at least one suspended rail member, and the at least one roller of the drawer assembly comprising a concave surface that substantially corresponds to a curved outer surface of the at least one suspended rail member.

2. The desk according to claim 1, wherein at least one of the leg members comprises intersecting diagonal members with a central rectangular member circumscribing the intersection point of the diagonal members.

3. The desk according to claim 1, wherein the desk tabletop comprises a glass panel supported on a tabletop frame, the tabletop frame being coupled to the at least one pair of the leg members.

4. The desk according to claim 1, wherein the at least one suspended rail member comprises a first suspended rail member and a second suspended rail member, the first suspended rail member being laterally spaced apart from the second suspended rail member, and the support carriage of the drawer assembly being adjustably supported on the first and second suspended rail members.

5. The desk according to claim 4, wherein the first and second suspended rail members are supported between the leg members of the desk.

6. The desk according to claim 4, wherein each of the first and second suspended rail members has a circular cross section.

7. The desk according to claim 1, wherein the support carriage of the drawer assembly comprises a pair of side frame members, at least one pair of drawer frame members, and a bottom wall, the at least one pair of drawer frame members operating as tracks for the one or more slidable drawer members.

8. The desk according to claim 1, wherein the one or more slidable drawer members of the drawer assembly comprise a first slidable drawer member and a second slidable drawer member, the first slidable drawer member being disposed above the second slidable drawer member.

9. A desk with a slidable drawer assembly, the desk comprising:

at least one pair of leg members, a first of the at least one pair of leg members being spaced apart from a second of the at least one pair of leg members, at least one of the leg members comprising intersecting diagonal members with a central rectangular member circumscribing the intersection point of the diagonal members;

a desk tabletop supported on the at least one pair of leg members, the desk tabletop having a top surface and a bottom surface oppositely disposed relative to the top surface;

first and second suspended rail members, the first suspended rail member being laterally spaced apart from the second suspended rail member, the first and second suspended rail members supported by the at least one pair of leg members, the first suspended rail member being spaced apart from the bottom surface of the desk tabletop by a first gap, and the second suspended rail member being spaced apart from the bottom surface of the desk tabletop by a second gap; and a drawer assembly adjustably supported on the first and second suspended rail members, the drawer assembly comprising a support carriage with one or more slidable drawer members, the support carriage configured to be slidably displaced on the first and second suspended rail members so as to enable a user of the desk to selectively adjust a position of the drawer assembly of the desk.

10. The desk according to claim 9, wherein the desk tabletop comprises a glass panel supported on a tabletop frame, the tabletop frame being coupled to the at least one pair of the leg members.

11. The desk according to claim 9, wherein the first gap between the first suspended rail member and the bottom surface of the desk tabletop is substantially equal to the second gap between the second suspended rail member and the bottom surface of the desk tabletop.

12. The desk according to claim 11, wherein the first and second suspended rail members are supported between the leg members of the desk.

13. The desk according to claim 11, wherein each of the first and second suspended rail members has a circular cross section.

14. The desk according to claim 9, wherein the drawer assembly further comprises at least one roller, the at least one roller slidably coupling the drawer assembly to one of the first and second suspended rail members.

15. The desk according to claim 14, wherein the at least one roller of the drawer assembly comprises a concave surface that substantially corresponds to a curved outer surface of the one of the first and second suspended rail members.

16. The desk according to claim 9, wherein the support carriage of the drawer assembly comprises a pair of side frame members, at least one pair of drawer frame members, and a bottom wall, the at least one pair of drawer frame members operating as tracks for the one or more slidable drawer members.

17. The desk according to claim 9, wherein the one or more slidable drawer members of the drawer assembly comprise a first slidable drawer member and a second slidable drawer member, the first slidable drawer member being disposed above the second slidable drawer member.

* * * * *